US006773538B2

(12) United States Patent
Blessing

(10) Patent No.: US 6,773,538 B2
(45) Date of Patent: Aug. 10, 2004

(54) METHOD OF MAKING COUNTERTOPS

(76) Inventor: Ronald Lee Blessing, P.O. Box 574, Dallas, OR (US) 97338

( * ) Notice: Subject to any disclaimer, the term of this patent is extended or adjusted under 35 U.S.C. 154(b) by 0 days.

(21) Appl. No.: 10/314,073

(22) Filed: Dec. 6, 2002

(65) Prior Publication Data

US 2004/0108053 A1 Jun. 10, 2004

(51) Int. Cl.[7] ..... B32B 31/00

(52) U.S. Cl. ..... 156/256; 156/71; 156/91; 156/92; 156/182; 156/257; 156/258; 156/263; 156/267; 156/268; 52/782.22

(58) Field of Search ..... 156/71, 91, 92, 156/257, 258, 263, 267, 268, 182, 256; 52/782.22

(56) References Cited

U.S. PATENT DOCUMENTS 3,077,012 A * 2/1963 Speraw ..... 52/782.22
D328,001 S * 7/1992 Kelly ..... D6/511
5,310,435 A * 5/1994 Kelly ..... 156/182
6,183,585 B1 * 2/2001 Kelley ..... 156/182
6,309,501 B1 * 10/2001 Kelley ..... 156/257

* cited by examiner

*Primary Examiner*—Linda L. Gray
(74) *Attorney, Agent, or Firm*—Carl D. Crowell

(57) ABSTRACT

An improved method of countertop manufacture having a laminate or veneer horizontal upper surface and a laminate or veneer vertical face with a corner element with an arcuate surface that smoothly fairs into both the upper surface and the face. The countertop is manufactured by first mounting a piece of solid surface to a backer and finishing to a desired arc. The solid surface is then bonded to the vertical laminate surface and substrate to create a joined edge piece. The joined edge piece is finished to form a flat base. The finished edge piece with an arcuate corner element is then bonded to the horizontal surface to form a countertop with a rounded corner joining the vertical laminate surface and horizontal upper surface.

4 Claims, 2 Drawing Sheets

Fig. 1
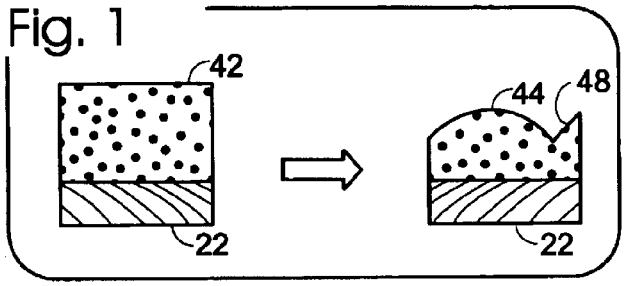
Fig. 2
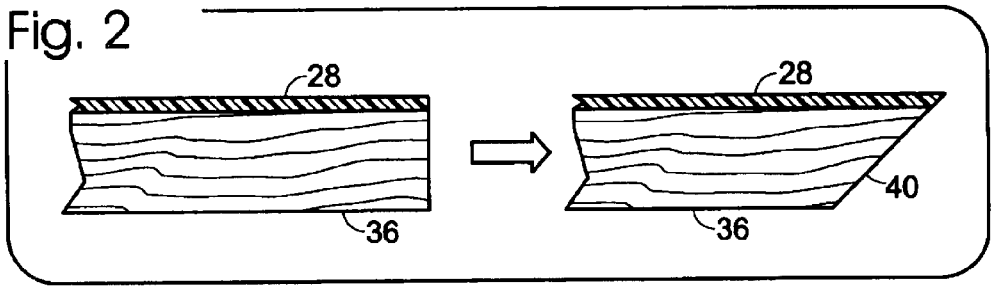
Fig. 3
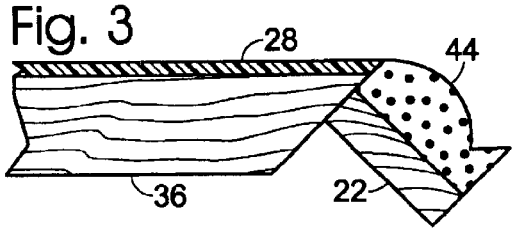
Fig. 4
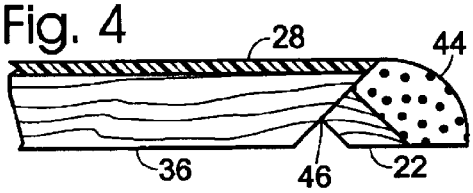
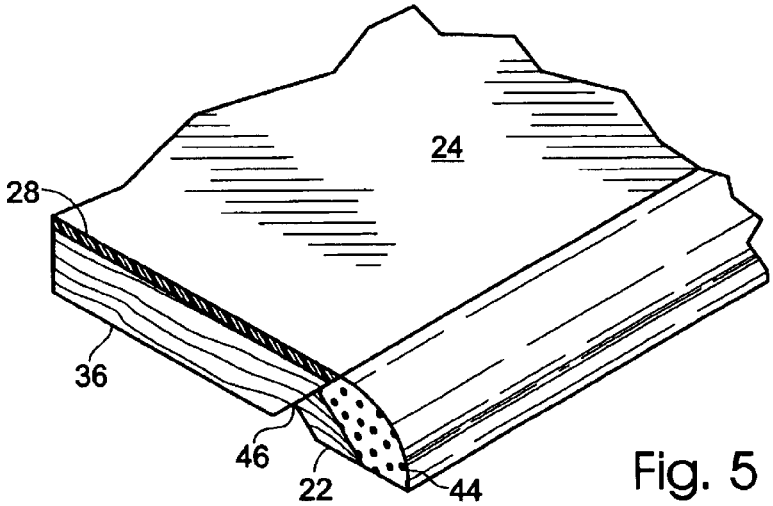
Fig. 5

METHOD OF MAKING COUNTERTOPS

BACKGROUND AND SUMMARY OF THE INVENTION

This invention relates to countertops, and in particular to a smooth or rounded edge for laminate or veneer countertops.

Countertops such as kitchen counters, tables, furniture and the like, generally consist of a horizontal work surface and a largely ornamental vertical surface or face. When laminates or veneers are used on both the horizontal upper surface and the vertical face of countertops there are difficulties in joining these horizontal and vertical surfaces. Traditionally there has been a sharp right angle corner between the horizontal and vertical surface. Because of its sharpness, this corner is easily damaged when it is hit and when damaged it is difficult to repair. A sharp right angle corner is not as aesthetically pleasing as a rounded corner in most countertop applications. Recently there have been methods of introducing rounded corners for laminate countertops.

Methods of installing an aesthetically pleasing rounded countertop include the methods of U.S. Pat. Nos. 5,310,435, and 6,183,585 to Kelley, (Kelley patents). The Kelley patents involve the placement of a component of solid surface, such as is commonly sold under the trademark name CORIAN, into notches in an edge piece of countertop, then finishing the surfaces to a desired radius to form a rounded edge.

Problems with this system include cutting solid surface material such as CORIAN to a rounded edge while this material is affixed to a laminate surface. Laminate surfaces as are commonly found in countertops often have a very thin color layer. Cuts or abrasions easily penetrate this color layer revealing what is often a dark underlayer. This results in significant waste and loss of time as the entire solid surface and laminate component must be discarded.

Solid surface materials also tend to be very expensive. It is desirable to have a method manufacturing rounded edge countertops that uses minimal amounts of solid surface material.

Other problems with the known prior art include the difficulty bonding or gluing solid surface materials to other surfaces. Solid surface materials commonly used in countertops by their nature are nominally porous and resistant to binding to prevent staining and facilitate cleaning. While these materials may be glued, they often require specialized glues and extended set time and clamping.

The subject invention overcomes the foregoing shortcomings and limitations of laminate and veneer countertops by providing an improved method for manufacture of a vertical countertop surface for joining with the horizontal work surface. A solid surface corner element is located between the horizontal and vertical laminate surfaces with an arcuate or radiused finished surface that fairs into both pieces of laminate. The edges of both pieces of laminate are covered by the corner element. If desired, a second arcuate corner element, similar to the first corner element, can be placed at the lower corner of the edge piece to give a more rounded appearance. The specific improvements of the present invention relate to the finishing of the solid surface corner element prior to bonding to the vertical laminate piece permitting the radiused surface to be finished to 90 degrees or more. Further improvements over the prior art include the mounting of thinner pieces of the expensive solid surface to a less expensive backer material for cost savings and to facilitate bonding of the solid surface corner component to the vertical laminate surface.

The edge piece of the subject invention is made by cutting an arc or radius into a strip of solid surface material. This cut may be of any arc, but will generally be 90 degrees or greater and later finished to 90 degrees to effect a square corner. The solid surface component may be mounted on a backer of wood or wood product material to permit the use of thinner solid surface material than would normally be needed, resulting in cost savings. The vertical laminate surface is mounted to a substrate. The mounted piece is cut at an angle to permit the solid surface component to be glued to the vertical laminate piece such that the tangent of the arc of the solid surface component at the point of the joining resides within or near the plane of the vertical laminate piece surface. The back of the vertical laminate piece substrate and the now joined solid surface corner element create a joined edge piece. The joined edge piece is then finished by removing all overhang portions of the corner element permitting a flush mounting to the face of the horizontal laminate work surface or countertop.

In a preferred embodiment of the invention, a groove is retained in the base of the vertical laminate piece and the joined solid surface corner element to facilitate gluing. The joined edge piece may also be finished such that the tangent of the arc of the remaining solid surface edge is just greater than 90 degrees to provide a higher degree of finish on joining to the horizontal laminate piece to joined edge piece.

Further benefits of the invention include the ability to use very expensive and exotic material in the corner element at a significant cost savings through the use of a backer and the ability to finish the arc of the solid surface component to any angle desired, in particular, angles of greater than 90 degrees.

Accordingly, it is a principal object of the present invention to provide for the improved manufacture of a countertop having a laminate or veneer horizontal top surface and vertical edge face with a solid surface corner component.

It is a further object of the subject invention to reduce production material costs by reducing the amount of solid surface component necessary.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIGS. 1–4 are a series of cross-sectional views showing the sequence of construction of the edge piece of the countertop.

FIG. 5 is a perspective view of the finished edge piece of the countertop.

PREFERRED EMBODIMENT OF THE INVENTION

Figure 6:
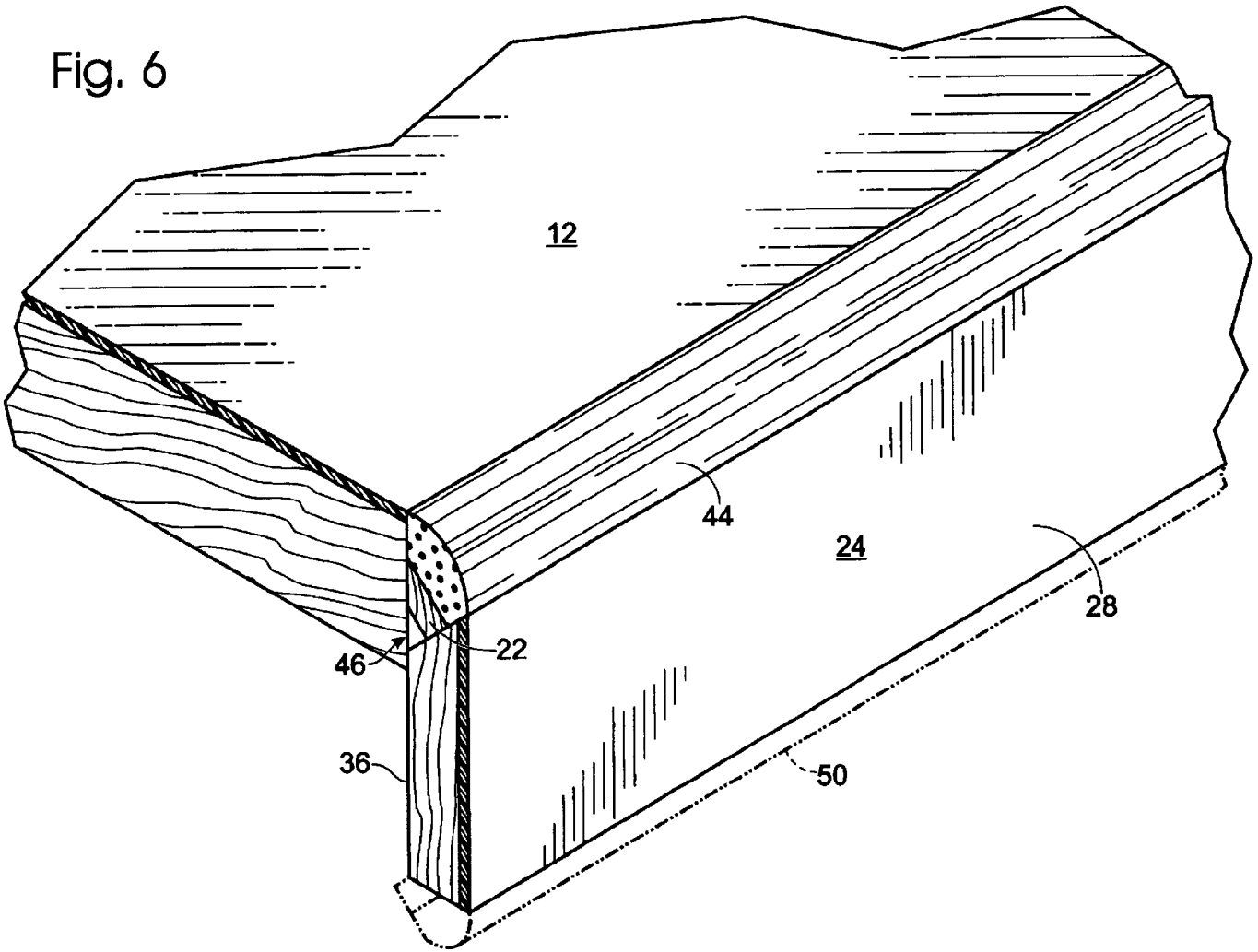
FIG. 6 is a perspective view of a countertop embodying the subject invention.

Countertops of this type are commonly used on kitchen cabinets and similar structures. However, the invention can also be utilized with decks made from veneer covered wood or similar materials, such as is used on tables, desks, and other furniture items.

Referring to the drawings, the various components involved with the method of the invention retain their indicators throughout the figures. The invention relates to the process of finishing a horizontal surface 12 with an exposed vertical edge with a vertical laminate surface 28 and a rounded or arcuate solid surface corner element 44.

The horizontal surface 12 in most countertops such as will be utilized with the invention are comprised of a sheet of laminate or veneer mounted on a base of wood or wood substitute. Generally the finished laminate surface is bounded on all sides by exposed vertical edges of the base.

Referring to FIGS. 1–3 of the drawings, a length of solid surface component 42 such as thermoplastic material of the type sold under the trademark CORIAN is preferably affixed to a wood or wood substitute backer 22. The desired curved edge is then is fabricated by finishing an arc into the upper surface of a solid surface component 42, forming an arcuate solid surface component 44 with a desired arc. This arc may be formed by any number of shaper means, including but not limited to high speed rotating blades such as are commonly used in routers. The finished arc is preferably greater than 90 degrees with a later removed clamping lip 48 that may be left to facilitate gluing. At a later step, this component is cut to or near 90 degrees.

The joined edge piece 24 is made from an elongate rectangular cross-sectioned block of wood or wood substitute substrate 36 which has approximately the same height as the desired joined edge piece 24, FIG. 2. A laminate strip 28 is attached to one side of the substrate 36 to provide the outside or finished surface. At least one edge is mitered, or cut to a desired angle, to form a beveled angle face 40.

The arcuate solid surface component 44, is affixed to the beveled angle face 40 to form the joined edge piece 24. The surfaces are aligned and secured by means such as glue. Additional clamping stability is provided with the retention of a clamping lip 48 when the arcuate surface is cut. While an arcuate solid surface component 44 may be utilized without a backer 22, an improvement of the present preferred embodiment is the providing of a wood or wood substitute backer 36 which may be bonded to a wood or wood substitute substrate 22. Solid surface thermoplastic material requires special care when gluing, often require special glues and increased bond times. Permitting two wood type surfaces 22, 36 to be joined in the bond greatly facilitates and speeds assembly.

The back side of the edge piece 24 and the overhanging portions of the solid surface component 44 and backer 22 are cut to form a finished end piece 24 that is to be affixed to the exposed vertical edge of the horizontal laminate work surface 12. In a preferred embodiment, shown in FIGS. 1 and 5, a groove 46 is retained in the back side of joined edge piece 24. This provides a groove 46 for receiving any extra glue both in the bonding of the solid surface component 44 to the bevel angle face 40 and the later bonding of the joined edge piece 24 to the horizontal laminate work surface 12.

In the finishing of the joined edge piece 24 is it disclosed and preferable that it be finished such that the vertical laminate surface 28 and back of the substrate 36 be a few degrees off parallel. Preferably the thickness of the joined edge piece 24 along the edge with the solid surface component 44 is slightly thicker than the balance of the joined edge piece 24 to facilitate creating a smooth edge when bonded to the exposed vertical edge of the horizontal surface 12.

In an alternate embodiment of the invention, shown in dashed line, FIG. 6, a second corner element 50 may be glued to the joined edge piece 24 to provide rounded corners both at the intersection of the horizontal laminate work surface 12 and at the lower edge of the joined edge piece 24.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A method for forming a countertop comprising:

(a) placing a laminate sheet the upper surface of a horizontal work surface having an elongate exposed vertical edge;

(b) placing a laminate strip of the face side of a substrate material having a length substantially equal to the length of said exposed vertical edge;

(c) forming an arcuate surface on a solid surface component having a length substantially equal to the length of said substrate;

(d) cutting a mitered edge along one edge of the back side of said substrate, said mitered edge extending along the entire length of said substrate;

(e) adhesively joining said arcuate solid surface component to said mitered edge of said substrate to form a joined edge piece;

(f) finishing said joined edge piece to form a relatively planar back;

(g) attaching said finished edge piece to said horizontal work surface forming an arcuate corner element between said horizontal work surface and said laminate strip on the face side of said substrate material.

2. The method of claim 1 including the additional step of prior to forming an arcuate surface on said solid surface component attaching a backer to said solid surface component.

3. The method of claim 2 including the additional step adhesively joining said to substrate to said backer.

4. The method of claim 1 including the additional step of finishing said edge piece to form said relatively planar back such that the thickness of said edge piece is slightly grater proximate said solid surface component than the thickness of the balance of said edge piece.

* * * * *